US005649019A

United States Patent [19]

Thomasson

[11] Patent Number: 5,649,019

[45] Date of Patent: Jul. 15, 1997

[54] DIGITAL APPARATUS FOR REDUCING ACOUSTIC FEEDBACK

[76] Inventor: Samuel L. Thomasson, 1038 E. Hearn Way, Gilbert, Ariz. 85234

[21] Appl. No.: 432,094

[22] Filed: May 1, 1995

Related U.S. Application Data

[63] Continuation-in-part of Ser. No. 120,187, Sep. 13, 1993, Pat. No. 5,412,734.

[51] Int. Cl.[6] ..... H04R 27/00

[52] U.S. Cl. ..... 381/83; 381/68.2; 381/68.4; 381/93

[58] Field of Search ..... 381/83, 93, 68.2, 381/68 A, 16; 379/392, 420; 84/675, 692, 694, 696, 699, 702, 706

[56] References Cited

U.S. PATENT DOCUMENTS

| | | | |
|---|---|---|---|
| 2,556,889 | 6/1951 | Stermer | 381/83 |
| 2,835,814 | 3/1958 | Dorf | 84/706 |
| 3,842,204 | 10/1974 | Leslie | 84/696 |
| 4,379,207 | 4/1983 | Kubota . | |
| 4,449,237 | 5/1984 | Stepp et al. | 381/93 |
| 4,747,132 | 5/1988 | Ibaraki et al. | 379/390 |
| 4,747,144 | 5/1988 | Admiraal et al. | 381/93 |
| 4,783,818 | 11/1988 | Graupe et al. | 381/71 |
| 4,815,140 | 3/1989 | Wagner | 381/93 |
| 4,859,127 | 8/1989 | Loughlin | 381/16 |
| 5,016,280 | 5/1991 | Engebretson et al. | 381/68 |

OTHER PUBLICATIONS

Chowning, John M., "The Synthesis of Complex Audio Spectra by Means of Frequency Modulation", Computer Music Journal, pp. 46–54, Apr., 1977.

"Electronic Filter Design Handbook —LC, Active, and Digital Filters" Arthur B. Williams, Fred J. Taylor; Second Edition; McGraw–Hill, Inc. (1988); pp. 7–1 to 7–44.

*Primary Examiner*—Forester W. Isen

*Attorney, Agent, or Firm*—Cahill, Sutton & Thomas P.L.C.

[57] ABSTRACT

Sound is converted into an electrical signal by a microphone and is converted into an inaudible, pulse width modulated signal that is combined with the electrical signal from the microphone, amplified, and converted into sound waves by a speaker. The pulse width modulator includes an A/D converter coupled to a shift register in a digital encoder. Any sound travelling from the speaker back to the microphone includes the inaudible component representing the original sound. The inaudible component is separated from the audible components, and the original sound is reconstructed in a pulse width demodulator including a shift register in a digital decoder coupled to a D/A converter. The reconstructed original sound is subtracted from the signal from the microphone, thereby reducing any echo and cancelling feedback. The apparatus includes amplitude correction circuitry for flattening the frequency response of the apparatus and includes phase correction circuitry for eliminating phase shifts in the apparatus.

19 Claims, 5 Drawing Sheets

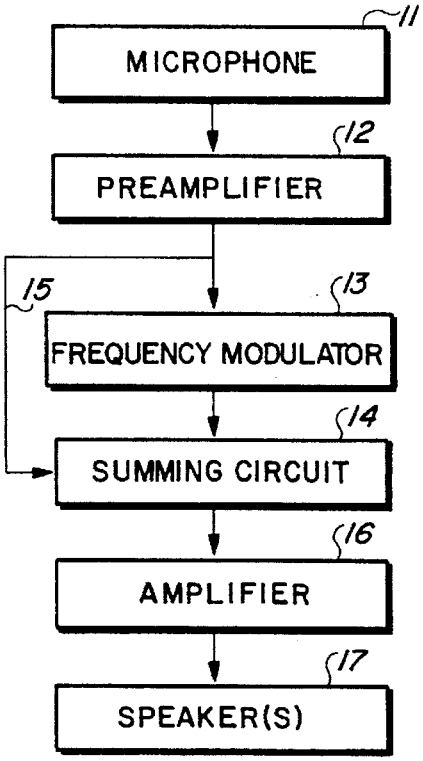
FIG. 1
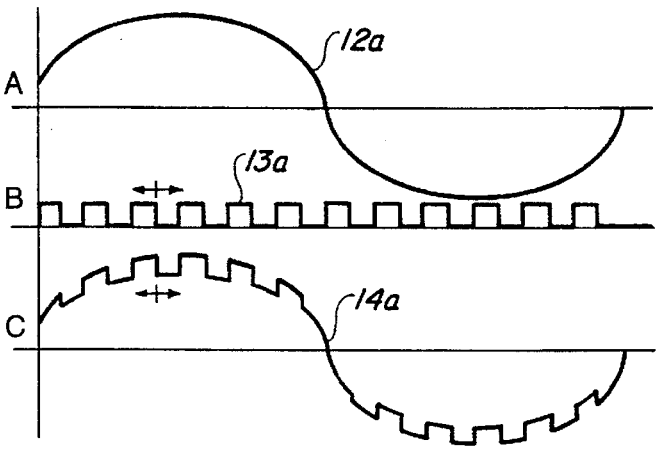
FIG. 2
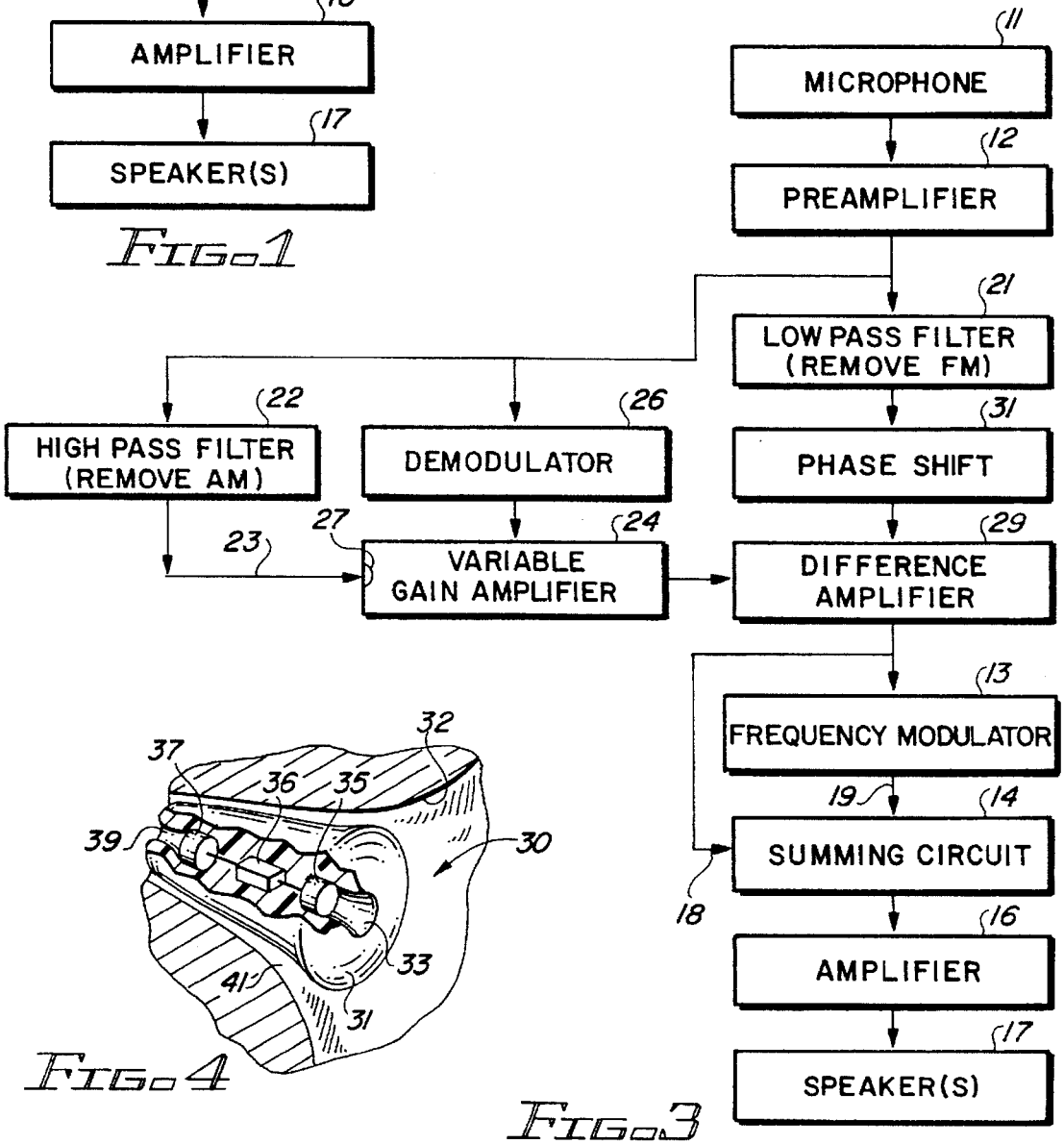
FIG. 3
FIG. 4

DIGITAL APPARATUS FOR REDUCING ACOUSTIC FEEDBACK

CROSS-REFERENCE TO RELATED APPLICATION

This application is a continuation-in-part of application Ser. No. 08/120,187 filed Sep. 13, 1993, now U.S. Pat. No. 5,412,734 issued May 2, 1995.

BACKGROUND OF THE INVENTION

This invention relates to feedback cancelling circuits and, in particular, to a circuit for reducing acoustic feedback in public address systems and in hearing aids.

A public address system is an "open loop" system in which sound is converted by a microphone into an electrical signal which is amplified and converted back into sound waves by one or more speakers. Sound waves are slight variations in air pressure which the microphone converts into an electrical signal of varying amplitude.

In theory, a signal passes through a public address system once, never to return. Outdoors and in well designed auditoriums or concert halls, this is essentially true. In other situations, a significant level of sound reaches the microphone from the speakers. When the output of an amplifier is coupled to the input of the amplifier, one has feedback, a closed loop with the potential to oscillate.

Acoustic feedback in a public address system can cause a mild echo or a self-sustaining ring, depending upon the loudness of the sound returning to the microphone. The cause of the feedback can be poor placement of a speaker relative to the microphone, walls that reflect sound, and/or simply having the volume set too high on the amplifier.

In a hearing aid, a microphone is connected to a speaker by a high gain (60–80 db) amplifier and is quite close to the speaker in a fitted earpiece. The earpiece is assumed to fit the ear canal exactly and the tissue of the ear canal is relied upon to isolate the speaker from the microphone. If the earpiece should move slightly and not seal the ear canal, an acoustic path is opened, connecting the speaker to the microphone. The misalignment of the hearing aid manifests itself as an unpleasant squeal that is audible even to those several feet from the wearer. The squeal is eliminated by reducing the gain of the amplifier by way of an external volume control on the hearing aid. Often the wearer is obliged to adjust the gain frequently as the loudness of background sounds and sounds of interest changes. While feedback is an annoyance in a public address system, feedback in a hearing aid can be more serious since it interferes with hearing and may cause the wearer not to use the hearing aid. High level feedback in a hearing aid may even damage the already impaired hearing of the wearer.

There are two difficulties to eliminating feedback in an acoustic system. One difficulty is determining whether the sound passing through the amplifier is an echo or an original sound and the second difficulty is determining the travel time of the echo. In the prior art, a variety of systems have been proposed for detecting an echo, typically assuming that a single frequency tone of large amplitude is an echo. When an echo is detected, either the gain of the amplifier is reduced or the signal from the microphone is filtered to eliminate the tone. In a hearing aid, reducing the gain temporarily shuts off the hearing aid causing a silent gap in what is heard. Filtering out a frequency or band of frequencies can have the same effect if the frequencies happen to be those which need amplification to be heard. Some systems in the prior art have a calibration mode for determining the time delay of an echo in order to cancel the echo. These systems are not amenable to being incorporated into a hearing aid.

U.S. Pat. No. 5,412,734 discloses an analog system for eliminating feedback. Although an analog system is effective and requires less bandwidth than a digital system, a digital system is more easily modified because a modification does not require a change in hardware.

Speakers and microphones introduce system errors that change with each speaker and microphone used because no two components are actually identical even if the components are the same brand and model. For example, substituting one speaker for another can affect the amplitude and phase of the feedback. Changing the placement of a speaker or of a microphone after a system is calibrated can introduce phase and amplitude errors.

In view of the foregoing, it is therefore an object of the invention to provide digital apparatus for reducing feedback.

A further object of the invention is to provide apparatus for reducing feedback without squelching or turning off the apparatus.

Another object of the invention is to provide a digital apparatus for reducing feedback independently of the delay of the feedback.

A further object of the invention is to provide digital apparatus in which an original sound is reconstructed from an inaudible part of an echo and is subtracted from the audible part of the echo, thereby cancelling or reducing the echo.

SUMMARY OF THE INVENTION

The foregoing objects are achieved in the invention wherein sound is converted into an electrical signal by a microphone and the electrical signal is amplified. The electrical signal also is converted into an inaudible, pulse width modulated signal that is combined with the signal from the microphone, amplified, and converted into sound waves by a speaker. The pulse width modulator includes an A/D converter coupled to a shift register in a digital encoder.

Any sound travelling from the speaker back to the microphone includes the inaudible component representing the original sound. The inaudible component is separated from the audible components, and the original sound is reconstructed in a pulse width demodulator including a shift register in a digital decoder coupled to a D/A converter. The reconstructed original sound is subtracted from the signal from the microphone, thereby reducing any echo and cancelling feedback.

The correction is independent of the time required for the sound to travel from the speaker to the microphone. The inaudible component preferably is detected in a phase locked loop circuit which inherently locks onto the loudest signal, thereby assuring that the loudest echo is cancelled if more than one echo arrive simultaneously at the microphone. The invention is particularly useful for hearing aids since the hearing aid is not shut off when an echo is detected and any new sound passes through the system unaffected.

BRIEF DESCRIPTION OF THE DRAWINGS

A more complete understanding of the invention can be obtained by considering the following detailed description in conjunction with the accompanying drawings, in which:

FIG. 1 is a block diagram of acoustic apparatus for converting original sound into sound having AM and FM components in accordance with the invention;

FIG. 2 is a group of waveforms illustrating the operation of the invention;

FIG. 3 is a block diagram of an echo cancelling circuit constructed in accordance with the invention;

FIG. 4 illustrates a hearing aid constructed in accordance with the invention;

DETAILED DESCRIPTION OF THE INVENTION

Figure 5:
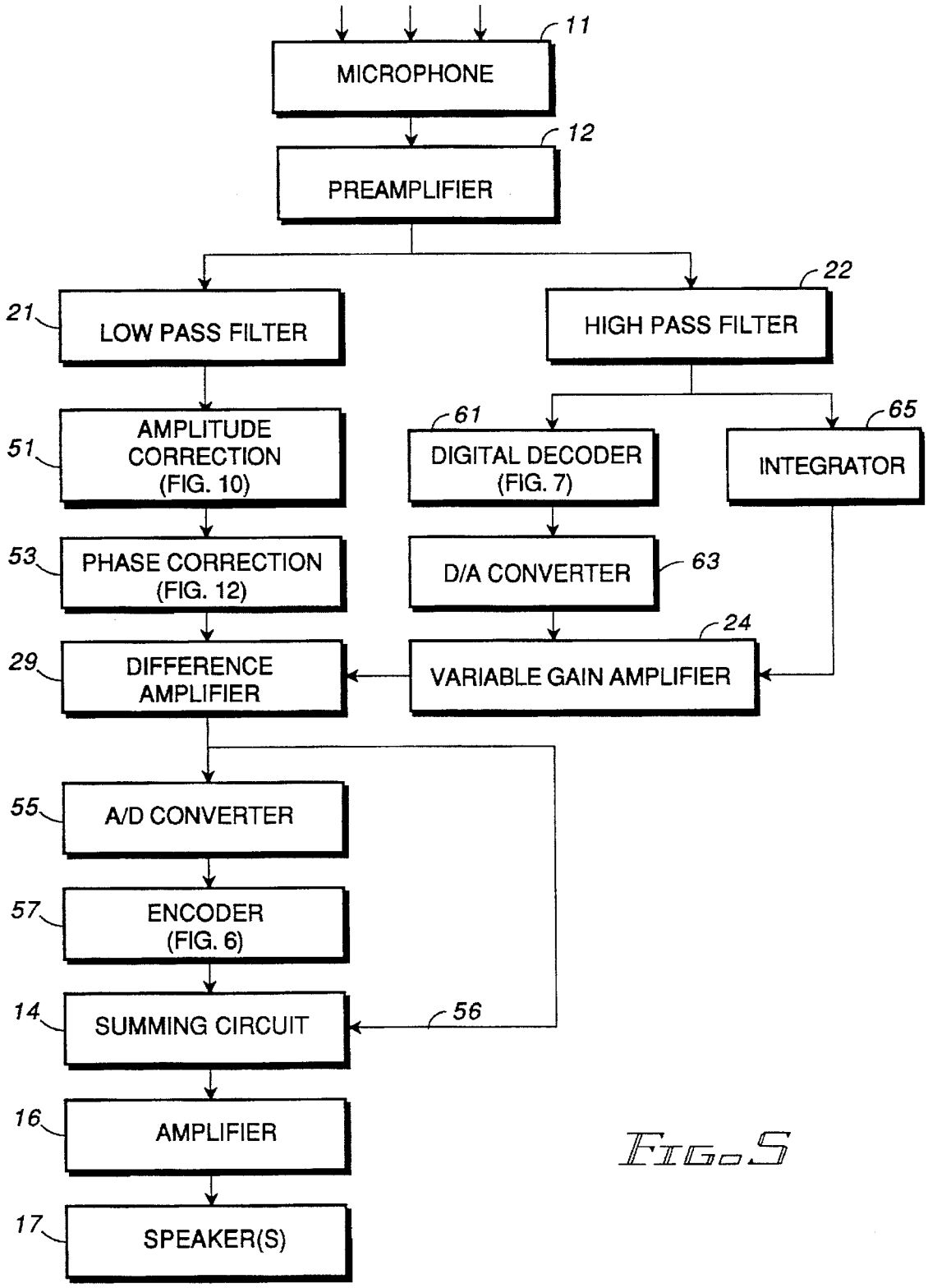
FIG. 5 is a block diagram of digital apparatus for reducing feedback constructed in accordance with a preferred embodiment of the invention.

FIG. 1 illustrates a simplified system for producing a sound from which an echo can be detected and cancelled in accordance with the invention. The echo cancelling portion of the system is included in FIG. 3. Referring to FIGS. 1 and 2, microphone 11 is connected to the input of preamplifier 12 which has an output connected to modulator 13. Waveform 12*a* represents a sinusoidal output signal from preamplifier 12. Modulator 13 produces frequency modulated signal 13*a* having a center frequency of about 30 kilohertz (30,000 cycles per second). Frequency modulation is a vibrato-like variation of the center frequency in which the deviation from the center frequency, represented by arrow 18, is in step with the signal from microphone 11. The frequency modulated signal is inaudible since human hearing is insensitive to sound waves above approximately 20 khz.

The output from modulator 13 is connected to a first input of summing circuit 14. The output of preamplifier 12 is connected by line 15 to a second input of summing circuit 14 which combines the frequency modulated signal with the signal from microphone 11. The output signal from summing circuit 14, represented by waveform 14*a*, is coupled to amplifier 16 which drives speakers 17.

In the block diagram shown in FIG. 1, microphone 11 is preferably an electret microphone, amplifier 12 is a transistor or operational amplifier, modulator 13 is a type 555 timer, summing circuit 14 is an operational amplifier or a transistor, amplifier 16 is an operational amplifier or a transistor, and speakers 17 are micro-speakers such as used in hearing aids. Generally, the amplifiers are transistors in a hearing aid and an integrated circuit in a PA system.

Speakers 17 must be capable of projecting a sound wave at 30 khz. For a hearing aid, this frequency is easily produced by the small speaker used. In public address systems, it may be necessary to add a super tweeter to a sound system in order to produce the frequency modulated component of the sound waves. The sound from speakers 17 has a frequency modulated (FM) component and an amplitude modulated (AM) component. As used herein, the AM component is a variable amplitude signal produced by microphone 11 in response to an original (audible) sound. (In radios, AM refers to amplitude modulation of a carrier. In the invention, there is no carrier, "AM component" or "baseband audio" refers to a variable amplitude signal.)

The apparatus of FIG. 1 converts original sound into a composite, louder sound having an AM component and an FM component. The FM component is derived from the AM component, i.e. the FM component includes the same information as the AM component, and the FM component provides a unique tag for the AM component since the FM component can only have been produced artificially. Thus, one can detect an echo by looking for an FM component in the signal from microphone 11. The FM component also provides a signal for removing an echo using the apparatus illustrated in FIG. 3, in which elements common to FIG. 1 have the same reference number.

The apparatus of FIG. 3 separates the incoming signal into an AM component and an FM component, reconstructs an echo from the FM component, and then subtracts the reconstructed echo from the AM component, thereby cancelling or nullifying the echo. Echo cancellation is independent of the acoustic delay since the FM and AM components travel together.

When an echo is received at microphone 11 (along with other sounds) the combined sounds are converted to an electrical signal by microphone 11 and amplified in preamplifier 12. The output of preamplifier 12 is connected to low pass filter 21, which removes the inaudible FM component and to high pass filter 22, which removes the AM component leaving only the FM component on line 23. The output from preamplifier 12 is also coupled to FM demodulator 26, which preferably includes a phase locked loop circuit. Phase locked loop circuits automatically lock onto the strongest signal, thereby assuring cancellation of any echo loud enough to cause ringing.

The output signal from demodulator 26 is an AM signal corresponding to the original sound and is connected to the signal input of variable gain amplifier 24. The output from high pass filter 22 is a signal proportional to the magnitude of the FM component and to the loudness of the echo. This signal is connected to gain control input 27 of variable gain amplifier 24. The output from variable gain amplifier 24 is a reconstructed echo of the original sound and this signal is coupled to one input of difference amplifier 29.

The output from low pass filter 21 is an AM signal containing the echo of the original sound plus additional signals. The second input to difference amplifier 29 is coupled to low pass filter 21 by phase shift circuit 31, described below. Difference amplifier 29 subtracts the reconstructed echo from the output of filter 21, leaving only the additional signals as a remainder.

The remainder is an AM signal, now a "new original" signal, coupled to input 18 of summing circuit 14. Input 19 of summing circuit 14 is connected to modulator 13. The AM component and FM component of the new original signal are combined in summing circuit 14, amplified in amplifier 16, and projected or transmitted by speakers 17.

In passing through the apparatus of FIG. 3, the AM component may become phase shifted relative to the FM component. Specifically, the FM component passes through modulator 13 and demodulator 26. These components may cause a sufficient phase shift in the reconstructed echo that the reconstructed echo does not cancel the echo. If so, phase shift circuit 31 is added to shift the phase of the echo by the same amount as the reconstructed echo is shifted. The adjustment for phase shift is made only once, at the time the circuit is constructed. The phase shift corrects for electrical delay internal to the apparatus of FIG. 3, the phase shift does not correct for external, acoustic delay of sound waves travelling from speakers 17 to microphone 11. The apparatus of FIG. 3 operates independently of acoustic delay because the FM and AM components travel together from the speaker to the microphone. Phase shift also corrects for speaker phase shift, which is usually significantly different in the ultrasonic spectrum from the audible spectrum.

The filters can be RC networks or more elaborate filters depending upon whether the application is hearing aids, where components must be as small as possible, or in PA systems, where size is irrelevant. Demodulator 26 is preferably a type 565 PLL, amplifier 24 is preferably a JFET, difference amplifier 29 is a transistor or an operational amplifier, and phase shift circuit 31 can be a type 555 modulator and type 565 demodulator connected in series or an impedance.

The apparatus of FIG. 3 can be implemented in a single integrated circuit and incorporated into a hearing aid. In FIG. 4, hearing aid 30 includes elongated body 31 closely fitting within ear canal 32. At a first end of body 31, hole 33 couples sound to microphone 35. Microphone 35 is connected to integrated circuit 36 which is powered by a suitable battery (not shown). Speaker 37 transmits sound into ear canal 32 through hole 39 in a second end of body 31.

If a gap, such as indicated by reference number 41, forms between ear canal 32 and body 31, an acoustic path is opened between speaker 37 and microphone 35. The gain of circuit 36 is high and an echo quickly becomes sustained oscillation at a large amplitude. However, the apparatus shown in FIG. 3 prevents oscillation from occurring by cancelling the echo while continuing to amplify other sounds for the wearer. There is no need for an external volume control, as often used in hearing aids of the prior art, because the gain of integrated circuit 36 does not have to be changed to avoid or to cancel feedback. Thus, a hearing aid constructed in accordance with the invention can be more compact than hearing aids of the prior art.

FIG. 5 illustrates a preferred embodiment of the invention in which a signal representing the original sound is processed digitally to reduce echo. As in the embodiment illustrated in FIG. 3, there are three kinds of sound which can strike microphone 11. A first kind is the original sound, a second kind is the audible echo of the original sound, and a third kind is an inaudible acoustic tag for reducing the echo.

Figure 10:
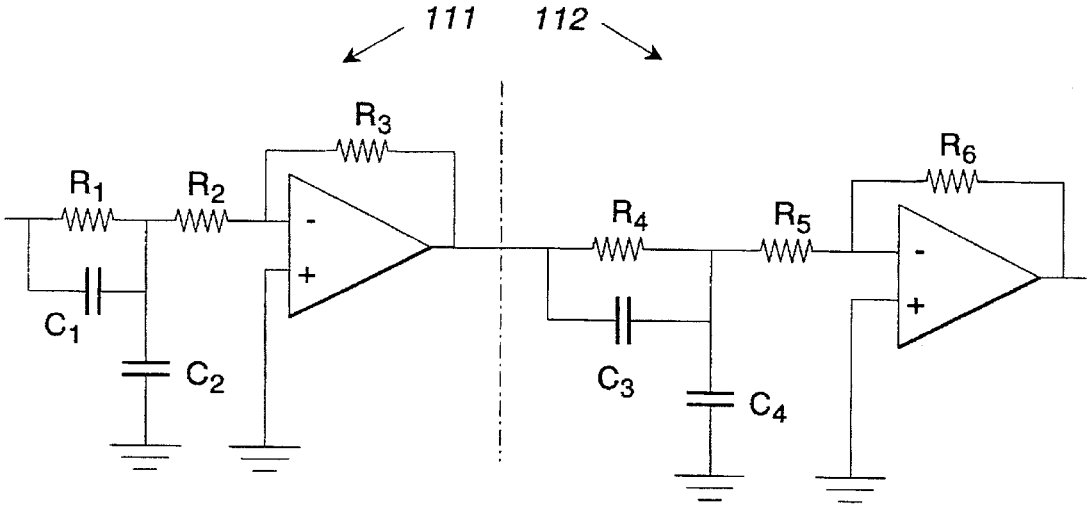
FIG. 10 is a schematic of a two stage, amplitude correcting circuit.

The sounds striking microphone 11 are converted into an electrical signal and coupled to preamplifier 12. Preamplifier is coupled to low pass filter 21 and high pass filter 22. Low pass filter 21 removes the inaudible portion of the sound and the low frequency portion of the sound is coupled to amplitude correction circuit 51. Microphone 11 does not have a flat frequency response, nor do speakers 17 or other portions of FIG. 5. Circuit 51 corrects for attenuation of some frequencies by having an amplitude vs. frequency characteristic that is the inverse of the remainder of circuit in FIG. 5; i.e., circuit 51 provides a flat frequency response. There are several techniques by which the inverse characteristic can be obtained. FIG. 10, described below, illustrates a preferred embodiment of an amplitude correction circuit.

The output signal from circuit 51 is coupled to phase correction circuit 53. Circuit 53 eliminates the phase shift introduced by the various other circuits in FIG. 5 and is the time domain analogue of amplitude correction circuit 51. Phase correction circuit 53 preferably includes all-pass filters as described in connection with FIGS. 12 and 13.

High pass filter 22 removes the low frequency or audible portion of the signal from preamplifier 12 and couples the remainder to digital decoder 61. Digital decoder 61 converts the incoming signal into a digital value having a predetermined number of bits. In one embodiment of the invention, the output from digital decoder 61 included six bits. The number of bits can be greater or less than six, although increasing the number of bits increases the bandwidth of the signal. If the bandwidth of the inaudible portion of the signal increases beyond 35–40 kilohertz, then custom speakers and microphones must be used instead of commercial grade speakers and microphones.

The six-bit digital signal from decoder 61 is applied to digital to analogue (D/A) converter 63. Decoder 61 and converter 63 are a pulse width demodulator for recovering the original signal from the inaudible modulation. The analogue signal from converter 63 is coupled to one input of variable gain amplifier 24. The output from high pass filter 22 is also coupled to integrator 65, which produces an output signal having a magnitude proportional to the average signal strength of the inaudible component of the sound detected by microphone 11. The output of integrator 65 is coupled to the gain control input of amplifier 24.

The output from variable gain amplifier 24 is a reconstruction of a earlier original sound and is coupled to one input of difference amplifier 29. The other input to difference amplifier 29 is connected to the phase correction circuit 53 which receives the low frequency signal. Difference amplifier 29 subtracts the reconstructed echo from the audible portion of the sound detected by microphone 11, thereby reducing or eliminating any echo.

The output from difference amplifier 29 is essentially only the original sound detected by microphone 11. This signal is coupled to A/D converter 55, which converts the signal to a series of digital pulses representative of the signal. For example, converter 55 includes circuit, known per se in the art, for sampling the incoming signal and providing a digital data representative of the amplitude of each sample. A typical sampling rate twenty kilohertz.

The data from converter 55 is coupled to encoder 57 which converts the data into an inaudible, pulse width modulated signal. Thus, converter 55 and encoder 57 are a pulse width modulator producing a signal having a fundamental frequency greater than about 20 khz. This signal is combined in summing circuit 14 with a signal from amplifier 29 and broadcast by way of amplifier 16 and speakers 17.

Figure 6:
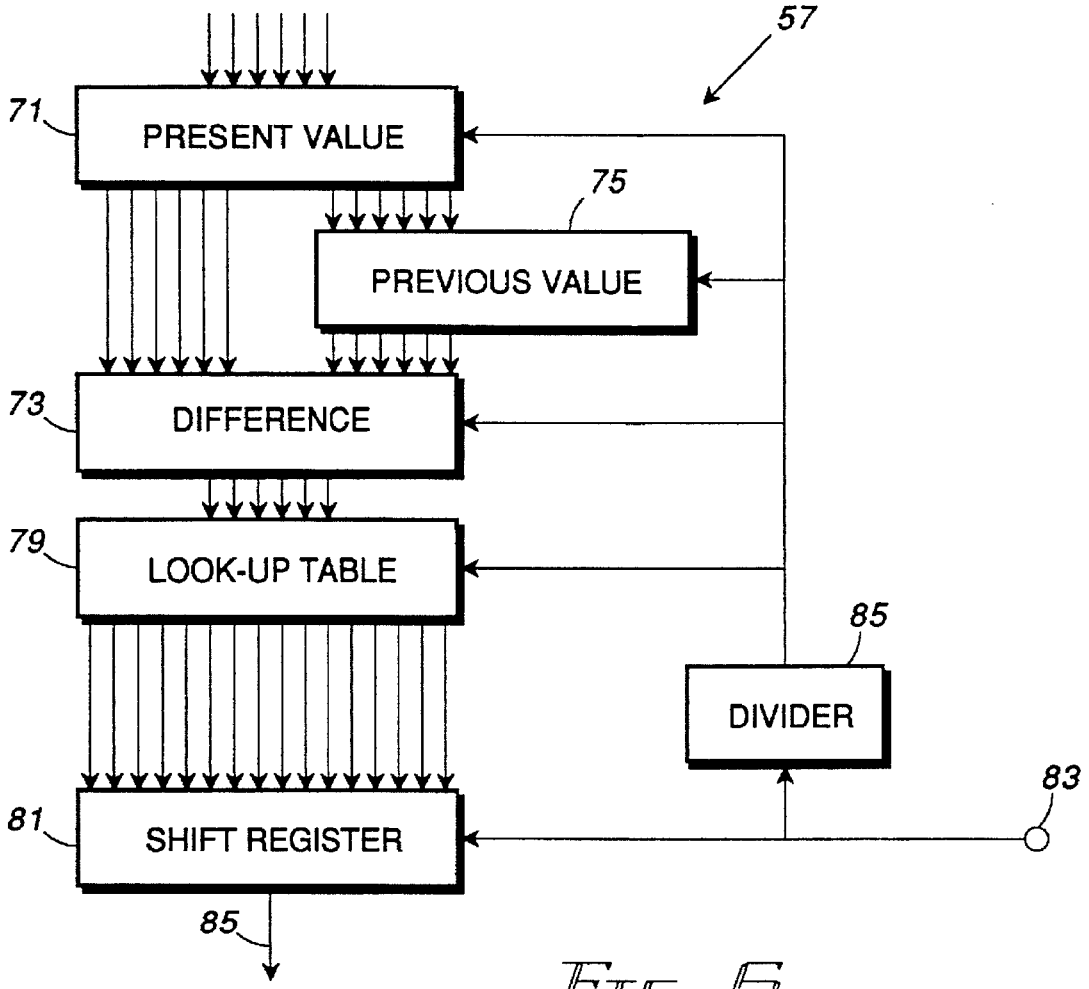
FIG. 6 is a block diagram of an encoder used in the invention.

Encoder 57 is illustrated in greater detail in FIG. 6. As illustrated in FIG. 6, encoder 57 is preferably a delta modulation system, that is, encoder 57 does not provide a stream of bits representative of the amplitude of each sample but, instead, provides a stream of bits representative of the change in amplitude from sample to sample.

In particular, encoder 57 includes first register 71 for receiving the value of the present sample from A/D converter 55. This value is coupled to difference circuit 73 wherein the present value is subtracted from the previous value stored in register 75. The operation of register 71, difference circuit 73 and previous value register 75 are controlled by clock signal divider 85. On each clock signal from divider 85, the present value is applied to difference circuit 73, the previous value is applied to difference circuit 73 and the difference is applied to look-up table 79. When the clock signal from divider 85 changes state, the present value is transferred from register 71 to previous value register 75. Upon the next change of state in the clock signal from divider 85, the present value and previous value are subtracted by difference circuit 73 and the difference coupled to look-up table 79. Thus, the data in the registers is alternately read and updated.

Table I which follows is a simplified example of the data in look-up table 79. As illustrated in FIG. 6 and Table I, the output from difference circuit 73 includes six lines, representative of six different levels of the audio signal. Depending upon which line is chosen, one row of data corresponding to that amplitude will be transferred to in parallel to shift register 81 upon a clock pulse from divider 85. The data in shift register 81 is transferred serially to output 85 under the control of clock pulses received at input 83. The amount that the clock signal from input 83 is divided by divider 85 depends upon the number of bits in shift register 81 and the number of levels of amplitude. For example, if the clock signal applied to input 83 has a frequency of 400 kilohertz, and divider 85 divides this signal by 16, then the clock input to register 71, difference circuit 73, register 75 and look-up table 79 is 25 kilohertz. Thus, each time the data is completely cycled through shift register 81, new data is read.

TABLE I

| Difference | Value produced by Look-Up Table | | | | | | | | | | | | | | | |
|---|---|---|---|---|---|---|---|---|---|---|---|---|---|---|---|---|
| +2.5 | 0 | 0 | 0 | 0 | 0 | 0 | 1 | 1 | 1 | 1 | 1 | 1 | 1 | 1 | 1 | 1 |
| +1.5 | 0 | 0 | 0 | 0 | 0 | 0 | 0 | 1 | 1 | 1 | 1 | 1 | 1 | 1 | 1 | 1 |
| +0.5 | 0 | 0 | 0 | 0 | 0 | 0 | 0 | 0 | 1 | 1 | 1 | 1 | 1 | 1 | 1 | 1 |
| −0.5 | 0 | 0 | 0 | 0 | 0 | 0 | 0 | 0 | 0 | 1 | 1 | 1 | 1 | 1 | 1 | 1 |
| −1,5 | 0 | 0 | 0 | 0 | 0 | 0 | 0 | 0 | 0 | 0 | 1 | 1 | 1 | 1 | 1 | 1 |
| −2.5 | 0 | 0 | 0 | 0 | 0 | 0 | 0 | 0 | 0 | 0 | 0 | 1 | 1 | 1 | 1 | 1 |

In Table I, assume that the data is read from shift register 81 starting from the right-most column. Thus, the first bit is always a one followed by a minimum of four additional ones and then zeros. A 0→1 transition occurs as the shift register cycles from the left hand most column of data to the right hand most column of data at output 85. This transition occurs at a regular interval, corresponding to 25 kilohertz, i.e. the clock frequency divided the number of bits. The 1→0 transition occurs a variable length period after the 0→1 transition. Thus, the output signal from shift register 81 is a pulse width modulated signal having a fundamental frequency of 25 kilohertz. It is preferred that the fundamental frequency of the output signal be inaudible.

The 1→0 transition occurs, on average, forty microseconds after the 0→1 transition at a fundamental frequency of 25 khz. As shown in Table I, there are an even number of states (rows), assuring symmetry about zero. If there were a separate value for zero, then the number of states would be odd and the output signal from shift register 81 would not average zero. Another reason that there is no entry for an input value of zero is that voltage comparators typically sense inequalities (greater than or less than), not equalities, which would be necessary to detect zero voltage.

Figure 7:
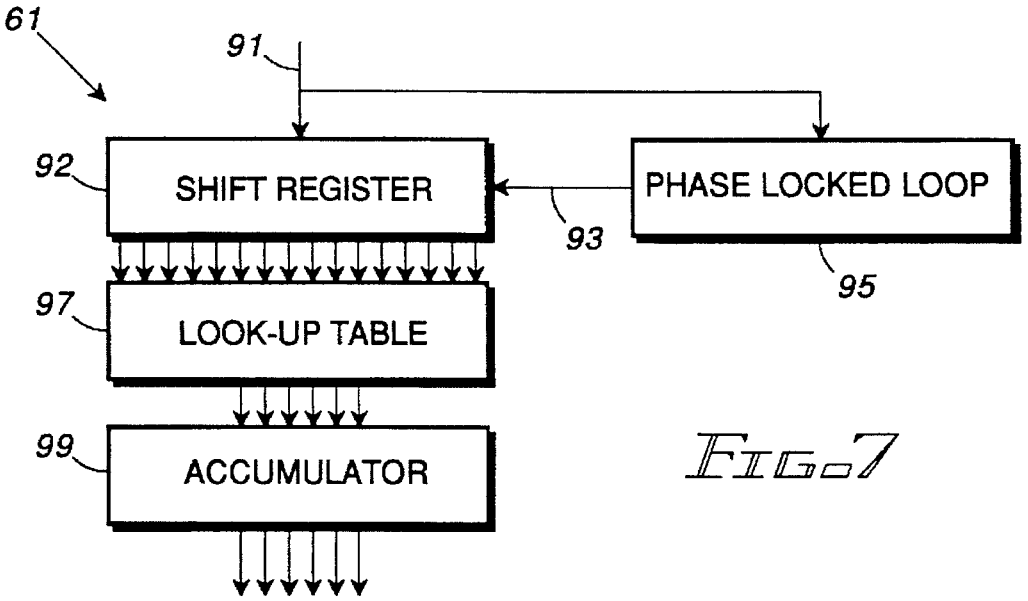
FIG. 7 is a block diagram of a decoder used in the invention.

FIG. 7 illustrates a preferred embodiment of decoder 61 (FIG. 5). Input line 91 receives a pulse width modulated signal from high pass filter 22 (FIG. 5) and couples the pulse width modulated signal to shift register 92 and phase locked loop 95. Phase locked loop 95 includes a local oscillator operating at 400 kilohertz that locks onto the incoming signal to produce a local clock signal of 400 kilohertz on output 93.

The pulses from input line 91 are loaded serially into shift register 92 and the data is transferred in parallel to look-up table 97. Look-up table 97 performs the inverse function of look-up table 79 (FIG. 6), translating a sixteen bit data word into a six bit data word indicative of the difference in amplitude between consecutive samples. The six bit data word is coupled in parallel to accumulator 99 which adds the incoming data to the data stored in the accumulator, thereby producing a data word representative of the amplitude of each consecutive sample.

In the embodiment illustrated in FIG. 7, accumulator 99 has a six bit output which is coupled to D/A converter 63 (FIG. 5). Converter 63 produces an analogue output representative of the original sound. As described above, this signal is adjusted in amplitude by amplifier 24 to completely reconstruct the original sound from the data encoded as an inaudible tag on the broadcast sound.

FIGS. 8–13 illustrate active filter networks suitable for use in implementing the invention. Active filters are described in detail in "*Electronic Filter Design Handbook*," A. B. Williams et al., McGraw-Hill, Inc. 1988. While there is no lack of texts on active filters, the Williams et al. text is the only text known which describes all-pass filters in detail.

Figure 8:
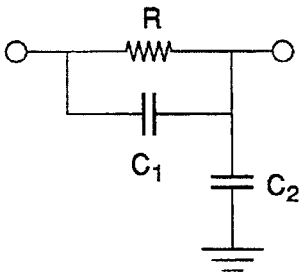
FIG. 8 is a schematic of a single stage, amplitude correction circuit.
Figure 9:
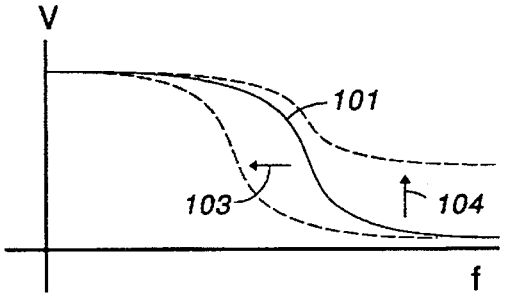
FIG. 9 illustrates the frequency response of the circuit in FIG. 8.

FIG. 8 is a single stage of an amplitude correcting circuit and has the frequency response shown by solid line 101 in FIG. 9. A plurality of such stages is cascaded to provide the desired frequency response. "Cascade" is intended to mean that the stages are connected in parallel (input to input and output to output) or serially (output to input), as desired. An amplifier is added between stages because each stage attenuates the input signal. An amplifier is not required for each stage if the signal is not severely attenuated, i.e., the RC networks can be cascaded.

Curve 101 is shifted to the left, as indicated by arrow 103, by decreasing the resistance of resistor R or by increasing the capacitance of capacitor $C_2$. The tail of curve 101 is raised, as indicated by arrow 104, by increasing the capacitance of capacitor $C_1$.

Figure 11:
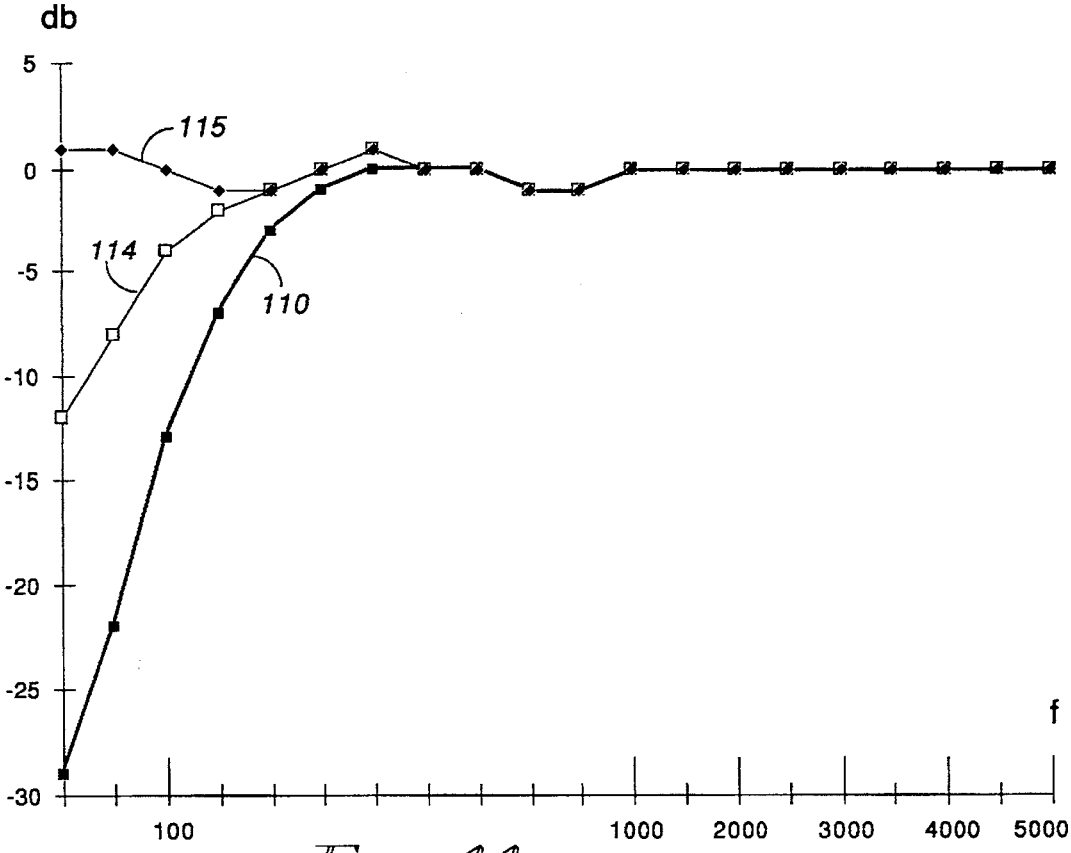
FIG. 11 illustrates the frequency response of the circuit in FIG. 10.

FIG. 10 is a schematic of a circuit for correcting the amplitude vs. frequency response of a circuit. The uncorrected response is represented in FIG. 11 by curve 110. The amplitude correction circuitry includes stage 111 and stage 112 coupled in cascade. An example of component values for stage 111 is as follows.

$R_1$=50 kΩ

$R_2$=50 kΩ

$R_3$=1 megΩ

$C_1$=0.01 μf $C_2$=0.1 μf

Stage 111 alone raises the low frequency amplitudes as indicated by curve 114 in FIG. 11. Adding second stage 112 further raises the low frequency amplitudes, as indicated by curve 115 in FIG. 11. While not perfectly flat, curve 115 is ±1 db of flat, which is far better correction than provided by hearing aids of the prior art and much flatter response than provided by microphones or speakers of the prior art.

An example of component values for stage 112 is as follows.

$R_4$=10 kΩ

$R_4$=10 kΩ

$R_6$=200 kΩ

$C_3$=0.1 μf $C_4$=1.0 μf

The circuit illustrated in FIG. 10 operates in the amplitude domain and provides amplitude correction as described above in connection with FIG. 5. Microphone 11, speakers 17, the filters in FIG. 5, and even the capacitances and inductances arising from the layout of a circuit on a printed circuit board, all cause phase shifts in the original sound. These phase shifts affect the quality of the sound and are eliminated or substantially reduced in accordance with the invention.

Figure 12:
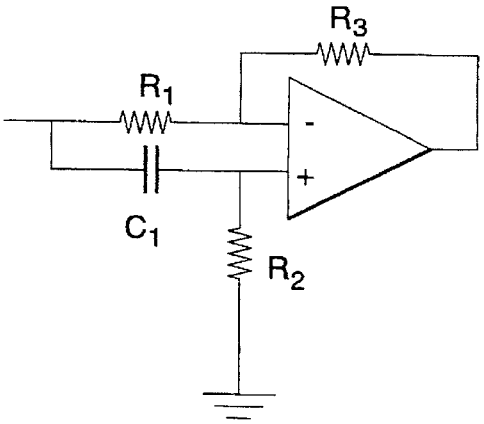
FIG. 12 is a schematic of a single stage, all-pass filter.
Figure 13:
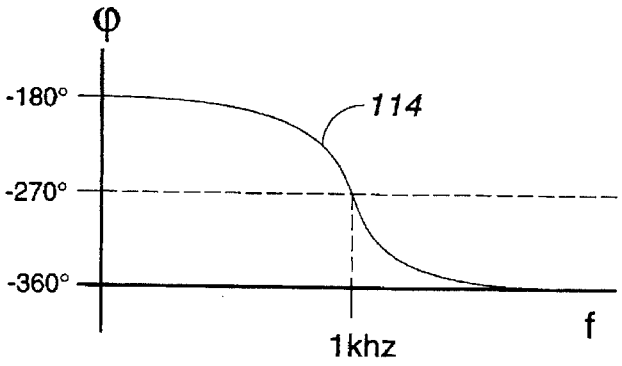
FIG. 13 illustrates the time domain response of the filter illustrated in FIG. 12.

FIG. 12 illustrates all-pass filter 120 and FIG. 13 illustrates the phase shift vs. frequency characteristic of the all-pass filter. All-pass filter 120 has a flat amplitude vs. frequency response, i.e., circuit 51 (FIG. 5) affects phase but circuit 53 (FIG. 5) does not affect amplitude vs. frequency. The particular values for the components depend upon the circuit being corrected and are readily determined empirically. An example of component values for all-pass filter 120 is as follows.

$R_1$=10 kΩ

$R_2$=1430 Ω

$R_3$=10 kΩ

$C_1$=0.1 μf

As shown by curve 114 in FIG. 13, this circuit has a flat amplitude response and a phase shift of −180° to −360° over a frequency range of 100 hz to 10 khz. The −270° point is at approximately 1 khz. If further correction were needed, additional stages can be cascaded with the first stage.

The invention thus provides apparatus for subtracting an echo from a signal, thereby cancelling any feedback through the apparatus without changing the gain of the apparatus or changing any other characteristic. New sounds received by the microphone pass through the apparatus unaffected. This is particularly useful in hearing aids since sounds other than the echo are passed through to the speaker. The hearing aid does not squeal or go silent if there is an echo as in hearing aids of the prior art. The invention can be used anywhere there is an unwanted echo, not just in public address systems and hearing aids. Examples of other uses are telephone (including cordless, cellular, etc.), Karaoke type "boom boxes" (portable sound systems), and interactive multimedia systems (e.g. computers with two way voice communication).

Having thus described the invention it will be apparent to those of skilled in the art that various modifications can be made within the scope of the invention. For example, the digital portions of the apparatus can be implemented in a microprocessor, in a single custom digital integrated circuit (ASIC), or in a single programmed logic array (PLA). The number of bits per word can be changed to suit a particular application. Six was chosen as the number of access lines for ease of illustration. Actually, the information on the six lines shown can be contained in three bit binary code (two data bits and one sign bit). Linear modulation can be used instead of delta modulation by changing the data in the look-up tables and coupling the D/A and A/D converters directly to their respective look-up tables. Other forms of modulation, e.g. delta-delta modulation, can also be used. The component values are for example only and can be varied as appropriate for a particular application. Amplitude and phase correction are preferably made in the low frequency side of the apparatus. Amplitude and phase correction could be added to the high frequency side (on the output of D/A converter 63) but this increases the cost of the apparatus and increases the number of adjustments.

What is claimed as the invention is:

1. A method for reducing acoustic feedback, said method comprising the steps of:

projecting a composite acoustic signal having a baseband audio component and a pulse width modulated component;

sensing said composite acoustic signal and converting said composite acoustic signal into an electrical signal having a baseband audio component and a pulse width modulated component;

separating said baseband audio component from said pulse width modulated component;

producing a reconstructed baseband audio component from said pulse width modulated component; and subtracting said reconstructed baseband audio component from said baseband audio component.

2. The method as set forth in claim 1 wherein said producing step comprises:

converting said pulse width modulated component into a serial bit stream;

applying said serial bit stream to a shift register having a parallel data output;

coupling said parallel data output to a digital to analog converter to obtain a baseband audio output signal from said digital to analog converter;

filtering said pulse width modulated component to produce an amplitude signal;

coupling said baseband audio output signal and said amplitude signal to a variable gain amplifier for amplifying said baseband audio output signal by an amount determined by said amplitude signal to produce said reconstructed baseband audio component.

3. The method as set forth in claim 1 and further comprising the step of:

adjusting the phase of said baseband audio component of said acoustic feedback to be in phase with said reconstructed baseband audio component.

4. The method as set forth in claim 1 wherein said projecting step comprises the steps of:

converting a sound into a baseband audio signal;

converting said baseband audio signal into a pulse width modulated signal;

combining said baseband audio signal and said pulse width modulated signal to produce a composite signal; and coupling said composite signal to at least one loudspeaker.

5. The method as set forth in claim 1 wherein said pulse width modulated component has a fundamental frequency greater than 20 khz.

6. Apparatus for producing an audible signal having inaudible modulation, said apparatus comprising:

a preamplifier for amplifying a baseband audio signal, said preamplifier having an output;

a pulse width modulator having an input coupled to the output of said preamplifier and an output, said modulator producing an output signal having an ultrasonic fundamental frequency;

a summing circuit having an output and a first input coupled to the input of said pulse width modulator and a second input coupled to the output of said pulse width modulator; and an amplifier coupled to the output of said summing circuit.

7. The apparatus as set forth in claim 6 wherein said pulse width modulator produces a signal having a fundamental frequency greater than 20 khz.

8. The apparatus as set forth in claim 6 and further comprising:

a difference amplifier having a first input coupled to the output of said preamplifier, a second input, and an output coupled to the input of said pulse width modulator; and a pulse width demodulator having an input coupled to the output of said preamplifier and an output coupled to the second input of said difference amplifier.

9. The apparatus as set forth in claim 8 and further comprising:

a high pass filter having an input coupled to the output of said preamplifier and an output;

a variable gain amplifier having a gain control input coupled to the output of said high pass filter, a signal input coupled to the output of said pulse width demodulator, and an output coupled to the second input of said difference amplifier.

10. The apparatus as set forth in claim 8 and further comprising:

a low pass filter having an input coupled to the output of said preamplifier and an output coupled to the first input of said difference amplifier.

11. The apparatus as set forth in claim 10 and further comprising:

a phase shift circuit having an input coupled to the output of said low pass filter and an output coupled to the first input of said difference amplifier.

12. The apparatus as set forth in claim 11 and further comprising:

a high pass filter having an input coupled to the output of said preamplifier and an output;

a variable gain amplifier having a gain control input coupled to the output of said high pass filter, a signal input coupled to the output of said pulse width demodulator, and an output coupled to the second input of said difference amplifier.

13. In a hearing aid having an elongated body fitting within a human ear canal, said body having a first end and a second end, a microphone in said body adjacent said first end, a speaker in said body adjacent said second end, and a circuit electrically connecting said speaker to said microphone, said circuit comprising:

a preamplifier coupled to said microphone, said preamplifier having an output;

a pulse width modulator having an input coupled to the output of said preamplifier, said modulator producing an output signal having an ultrasonic fundamental frequency;

a summing circuit having a first input coupled to the output of said preamplifier and a second input coupled to said pulse width modulator; and an amplifier having an input coupled to said summing circuit and an output coupled to said speaker.

14. The hearing aid as set forth in claim 13 and further comprising:

a difference amplifier having a first input coupled to the output of said preamplifier, a second input, and an output coupled to the input of said pulse width modulator; and a pulse width demodulator having an input connected to the output of said preamplifier and an output coupled to the second input of said difference amplifier.

15. The hearing aid as set forth in claim 14 and further comprising:

a high pass filter having an input coupled to the output of said preamplifier and an output;

a variable gain amplifier having a gain control input coupled to the output of said high pass filter, a signal input coupled to the output of said pulse width demodulator, and an output coupled to the second input of said difference amplifier.

16. The hearing aid as set forth in claim 14 and further comprising:

a low pass filter having an input coupled to the output of said preamplifier and an output coupled to the first input of said difference amplifier.

17. The hearing aid as set forth in claim 16 and further comprising:

a phase shift circuit having an input coupled to the output of said low pass filter and an output coupled to the first input of said difference amplifier.

18. The hearing aid as set forth in claim 17 and further comprising:

a high pass filter having an input coupled to the output of said preamplifier and an output;

a variable gain amplifier having a gain control input coupled to the output of said high pass filter, a signal input coupled to the output of said pulse width demodulator, and an output coupled to the second input of said difference amplifier.

19. A method for cancelling acoustic feedback of an original sound, said acoustic feedback having an audible part and an inaudible part, said method comprising the steps of:

projecting said original sound and an inaudible signal pulse width modulated by said original sound;

reconstructing said original sound from said inaudible, pulse width modulated part of said acoustic feedback; and subtracting the reconstructed original sound from the audible part of said acoustic feedback.

* * * * *